United States Patent [19]

Salomon et al.

[11] Patent Number: 4,917,400

[45] **Date of Patent: * Apr. 17, 1990**

[54] SKI BINDING FOR USE IN CROSS-COUNTRY OR MOUNTAINEER SKIING

[76] Inventors: Georges P. J. Salomon, Quintal, 74000 Annecy; Jacques Quellais, Epagny, 74410 Saint Jorioz, both of France

[ * ] Notice: The portion of the term of this patent subsequent to Mar. 3, 2004 has been disclaimed.

[21] Appl. No.: 901,641

[22] Filed: Aug. 29, 1986

Related U.S. Application Data

[63] Continuation of Ser. No. 577,484, Feb. 6, 1984, Pat. No. 4,647,064.

[30] Foreign Application Priority Data

Feb. 9, 1983 [FR] France ..... 83 02436

[51] Int. Cl.[4] ..... A63C 9/085

[52] U.S. Cl. ..... 280/615

[58] Field of Search ..... 280/614, 615, 617, 618, 280/631, 633, 634

[56] References Cited

U.S. PATENT DOCUMENTS

| | | | |
|---|---|---|---|
| 1,260,124 | 3/1918 | Ashley | 280/618 |
| 2,072,477 | 3/1937 | Dobb | 280/614 |
| 4,108,467 | 8/1978 | Kreyenbuhl | 280/615 |
| 4,382,611 | 5/1983 | Salomon | 280/615 |
| 4,498,687 | 2/1985 | Salomon | 280/615 |

FOREIGN PATENT DOCUMENTS

| | | | |
|---|---|---|---|
| 664662 | 9/1938 | Fed. Rep. of Germany . | |
| 2231058 | 12/1973 | Fed. Rep. of Germany | 280/614 |
| 2306721 | 11/1976 | France . | |
| 2399856 | 3/1979 | France . | |
| 2447731 | 8/1980 | France . | |
| 2489700 | 3/1982 | France . | |
| 8207758 | 3/1982 | France . | |

*Primary Examiner*—Charles A. Marmor
*Assistant Examiner*—Richard Camby

[57] ABSTRACT

A ski binding for securing a ski shoe or boot to a ski in a manner which permits the heel of the shoe or boot to be lifted away from the ski. The binding includes pivot means permitting the shoe or boot to pivot upwardly relative to the ski as the heel is lifted relative to the ski, and a flexion element which flexes as the heel of the boot is lifted beyond a predetermined extent.

40 Claims, 7 Drawing Sheets

SKI BINDING FOR USE IN CROSS-COUNTRY OR MOUNTAINEER SKIING

This is a continuation of application Ser. No. 5777,484, filed 2/6/84, issued as U.S. Pat. No. 4,647,064 3/3/87.

BACKGROUND OF THE INVENTION

1. Field of the Invention

The present invention relates to an apparatus for connecting one end of a shoe or boot to a ski which allows for lifting of the heel for skiing, particularly crosscountry or mountaineer skiing.

2. Description of Relevant Materials and Background

Various ski binding apparatus are known for securing the front end of a ski boot onto a ski for use in mountaineer or cross-country skiing. Such apparatus allows for the lifting of the heel, in certain cases even the entire boot, during walking. These apparatus generally comprise a flexible and elastic flexion element which connects the front of the boot to the ski.

In certain types of binding apparatus of this type, such as that described in French Application No. 76,09945, retention to the ski is achieved by means of a frontward extension of the sole of the boot, which is molded together with the sole and is of unitary construction therewith. Other types of binding apparatus, such as described in French Patent Application No. 79,02513, the disclosure of which is hereby incorporated by reference, comprise a flexible and elastic element constituted by an intermediate element attached to the ski and on which the front of the boot is interlocked and latched.

In all of these apparatus the tendency of the ski to remain on track is assured by the elasticity of the retention element in the binding which provides a force such that the ski tip remains in the track, e.g., by means of the elasticity of either the front edge of the sole or of the flexion element. The guidance of the ski along its original direction thus imposes a certain strain on the skier during the raising of his heel. This results in a consumption of energy during the entire lifting movement of the foot and leg, whereas pressure really need only be exerted at the end of the heel lifting movement, rather than throughout its entire extent. The initial lifting of the heel against a flexional resistance thus results in a needless waste of energy by the skier.

SUMMARY OF THE INVENTION

It is, therefore, an object of the invention to provide a ski binding which permits the user to lift his heel while exerting a minimum of effort during part of the lifting motion when there is no necessity of applying a downwardly directed moment on the front of the ski, while nevertheless allowing for the exertion of such a moment when needed as the heel is lifted to its upper extent.

The binding of the invention has pivot means permitting the shoe or boot to pivot upwardly relative to the ski as the heel is lifted relative to the ski. The binding further comprises a flexion element positioned forwardly of the toe portion of the shoe or boot which flexes as the heel of the boot is lifted beyond a predetermined extent. Preferably, the flexion element may be adapted to be secured at one end thereof to the shoe or boot and at the other end thereof to the ski. The ski binding of the invention is particularly adapted for use in cross-country or mountaineer skiing.

According to one embodiment of the invention the flexion element is secured at one end thereof to the shoe or boot by the pivot means which allows the shoe or boot to freely pivot relative to the flexion element as the heel of the shoe or boot is raised off of the ski. The end of the flexion element secured to the ski is fixedly secured thereto in a manner which prevents pivotable movement of the flexion element off of the ski. The pivot means, in one such embodiment, may comprise a rounded surface at the end of the flexion element; and a cooperating slide element associated with the boot. The pivot means further comprises a latching element for pivotably securing the boot to the flexion element, whereby the slide element overlays the rounded surface and slides thereover as the heel of the shoe or boot is lifted as the shoe or boot pivots. The latching element itself may be pivotably secured to the end of the flexion element adjacent the shoe or boot.

The flexion element itself in such an embodiment may be fixedly secured to the ski by an arch plate adapted to be secured to the ski. The arch plate may have lateral upright walls adapted to prevent substantial rotation of the binding around an axis transverse to the flat surface of the ski.

According to an alternative embodiment the flexion element itself is pivotably secured to the ski around a transverse journal axis at one end thereof. In this embodiment the flexion element is secured to the boot at one end thereof in a manner which allows for substantially no relative pivotable movement between the secured end and shoe or boot. The shoe or boot may be either detachably or integrally and permanently secured to the flexion element. Where detachably secured, the flexion element comprises an upstanding support element having an opening therein adapted to receive a forwardly extending latching element of the boot therein; and a movable latch adapted to secure the boot to the flexion element by locking the forwardly extending latching element in position relative to the upstanding support element.

In the above embodiment, the end of the flexion element which is adapted to be pivotably secured to the ski may be pivotably secured to a base plate adapted to be secured to the ski. The base plate has two uprights, with the end of the flexion element being pivotably secured between the uprights. The end of the flexion element secured to the base plate may, according to one approach, have a partially inclined abutment surface which permits the flexion element to pivot counterclockwise as the heel is raised. The flexion element is secured relative to the base plate such that when the heel has been raised by a predetermined extent, the abutment surface presses against the base plate to prevent further pivoting thereof, after which further lifting of the heel results in the flexion element being flexed.

Alternatively, the base plate may comprise a horizontal member extending between the uprights, and the flexion element may have its end pivotably secured to the base plate provided with a rounded configuration. The horizontal member is upwardly spaced from the flexion element to prevent pivoting of the flexion element relative to the base plate after the heel has been raised by a predetermined extent. In this case, the flexion element is adapted to be journalled to the ski, around a journal axis, by its front end, relative to the orientation of the boot, and the rear end thereof, relative to the orientation of the boot, may be integral with the front end of the boot, at least when the boot is in use.

In effect, the horizontal member defines a space having a height greater than the thickness of the flexion element, such that the horizontal member serves as an abutment to block rotation of the flexible element, after the heel has been lifted to the predetermined extent.

The invention is further directed to a shoe or boot for use in cross-country or mountaineer skiing. The boot or shoe has a forwardly extending latching element having a rounded surface thereon, the projection being configured for attachment to a ski by means of a ski binding. The rounded surface is positioned and configured to cooperate with a corresponding slide surface on the binding as the heel of the shoe or boot is lifted which results in the pivoting of the shoe or boot. In one embodiment, the rounded surface is located on the underside of the projection. The shoe or boot may further comprise a groove extending transverse to the general orientation of the shoe or boot, with the groove being configured to seat a latching member therein.

The invention may also be taken as being directed to a binding sub-assembly comprising means allowing for reduced resistance to lifting of the heel during the initial lifting of the heel, and means providing for increased resistance to lifting of the heel as the heel is raised beyond a predetermined extent.

BRIEF DESCRIPTION OF THE DRAWINGS

The invention will now be described with reference to the annexed drawings, given by way of non-limiting example only, in which:

FIG. 1 is a lateral elevational view showing the binding of the invention in the open position;

FIG. 2 is a lateral elevational view illustrating the binding of FIG. 1 in the closed position;

FIG. 3 is a top view of the binding of FIG. 2;

FIG. 4 is a perspective view of the binding of FIGS. 1–3, in the closed position;

FIG. 5 is a lateral elevational view illustrating the rotational, or pivoting, phase of the apparatus; and FIG. 6 is a lateral elevational view illustrating another phase of use in which the boot is flexed.

FIG. 7 is a lateral elevational view of the binding in the open position before insertion of the boot;

FIG. 8 is a lateral elevational view illustrating the apparatus in the closed position with the boot in the binding;

.FIG. 9 is a top view of the binding apparatus shown in FIG. 8;

FIG. 10 is a perspective view of the binding of FIGS. 7–9; and

FIGS. 11 and 12 illustrate the binding in two of its phases of use, and in this respect correspond to FIGS. 5 and 6 of the preceding embodiment.

FIG. 13 is a lateral elevational view of the binding; FIGS. 14 and 15 are views similar to those of FIGS. 5 and 6 and show the binding in its different phases of use; and FIG. 16 is a perspective view of the binding apparatus before insertion of the boot into the binding.

DESCRIPTION OF PREFERRED EMBODIMENTS

Figure 1:
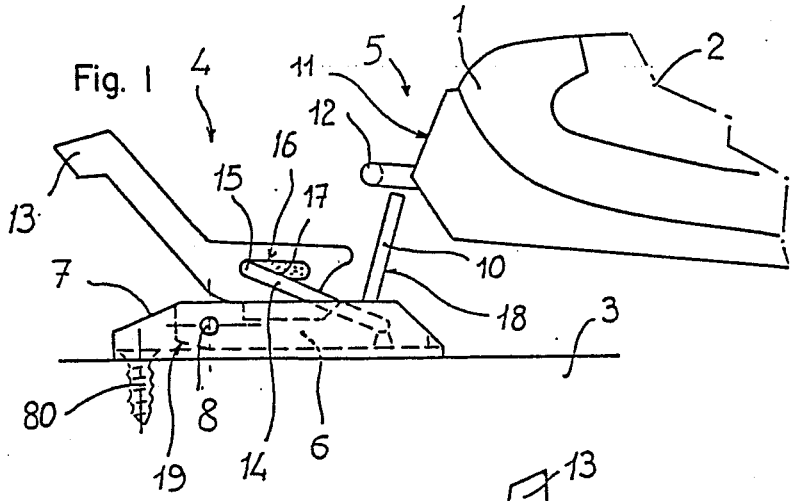
FIGS. 1–6 illustrate a first embodiment of the invention.

As was noted above, it is an objective of the invention to overcome the disadvantages described above and to provide a binding apparatus for binding the front of a shoe or boot onto a ski. The binding is preferably for use in cross-country or mountaineer skiing wherein the skier lifts or raises his heel in the course of moving his legs. The binding is generally characterized by the fact that the front of the boot is connected to the ski by a flexible flexion element. A pivot means ia also provided which is journalled to pivot around a transverse axis. The pivot means may comprise an abutment shoulder or surface to block the pivoting thereof at the end of a certain extent of lifting of the heel. Further lifting of the heel results in flexion of the flexible flexion element.

According to one aspect of the invention, the first phase of the lifting of the heel occurs freely, and is accompanied by rotation around a transverse axis. However, rotation or pivoting beyond a certain extent is blocked by a shoulder, and further lifting of the heel results in flexion of the flexion element.

It is another characteristic of the invention that the flexion and rotation occur beyond the front end of the boot.

According to other aspects of the invention, the flexion element can be either journal-mounted on the ski or be attached to the ski in a rigid manner, in which case it is the boot which is journalled with respect to the flexion element.

The first phase of the lifting of the boot occurs freely without consuming the energy of the skier (the extent of lifting may be 0–2O° with respect to angular lifting). Subsequently, lifting of the heel occurs against the elastic force of the flexion element which exerts a frontwardly directed moment on the ski, which is necessary for proper skiing. In this way, the ski is pressed against the snow as a result of the lifting of the heel, once the heel has been lifted beyond a predetermined extent. Thus, the desired effect is achieved without tiring the skier by requiring him to work against flexional forces throughout his entire gate.

FIGS. 1–6 illustrate a first embodiment of the invention. In this embodiment, binding apparatus 1 for connecting the front of the boot 2 to ski 3 comprises a binding 4, shown as being mounted on a level surface of the ski, in cooperation with he front portion 5 of the boot. Binding 4 comprises a movable and flexible flexion element 6 positioned in a base plate body 7 attached to the ski by virtue of screws 80. Flexion element 6 is substantially parallelpipedic and extends from the front to the rear of base plate body 7. The base plate has two uprights, or lateral walls 70 and 71 extending vertically on both sides of the lateral edges of the flexion element. The flexion element is at least partially deformable and is mounted at its front portion to pivot around a transverse axis S. However, the pivoting of element 6 is angularly limited, as will be noted below.

The front of the boot is secured onto element 6 by a retention apparatus 9. The retention apparatus is described in French Patent Application No. 2,447,731, the disclosure of which is hereby incorporated by reference, and need not be described in detail, particularly since this apparatus is given by way of example only. It need only be noted that element 6 extends rearwardly and comprises a support element 10 extending upwardly and that the front end 5 of boot 2 comprises a frontal support zone 11 as well as a latching element 12 which is spaced from the zone and extends in front of the boot. Furthermore, a movable latch 13 is connected to element 6 by a stirrup 14 which may be journalled. The upper portion 15 of stirrup 14 is positioned in slot 16 comprising an elastic element 17. Slot 16 is formed in movable latch 13 which is pivotably mounted on stirrup 14 around upper portion 15.

Insertion of the boot into the binding occurs by introduction of support element 10 between latching portion 12 and support zone 11 of the boot, and the retention is achieved by action of latch 13 on latching portion 12, which thus forces support zone 11 against abutment zone 18 of support element 10.

Figure 2:
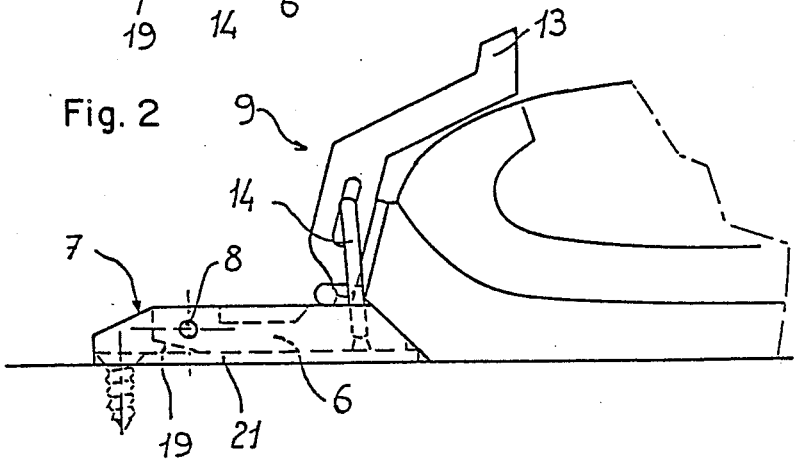
Figure 3:
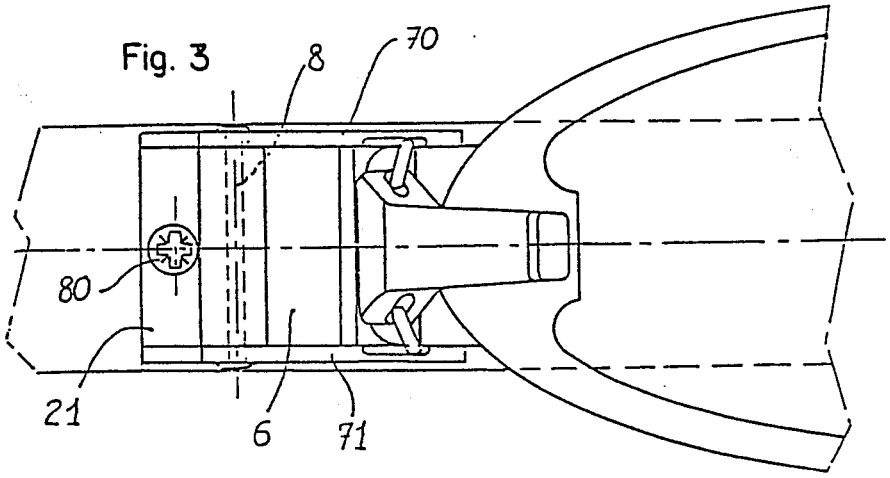
Figure 4:
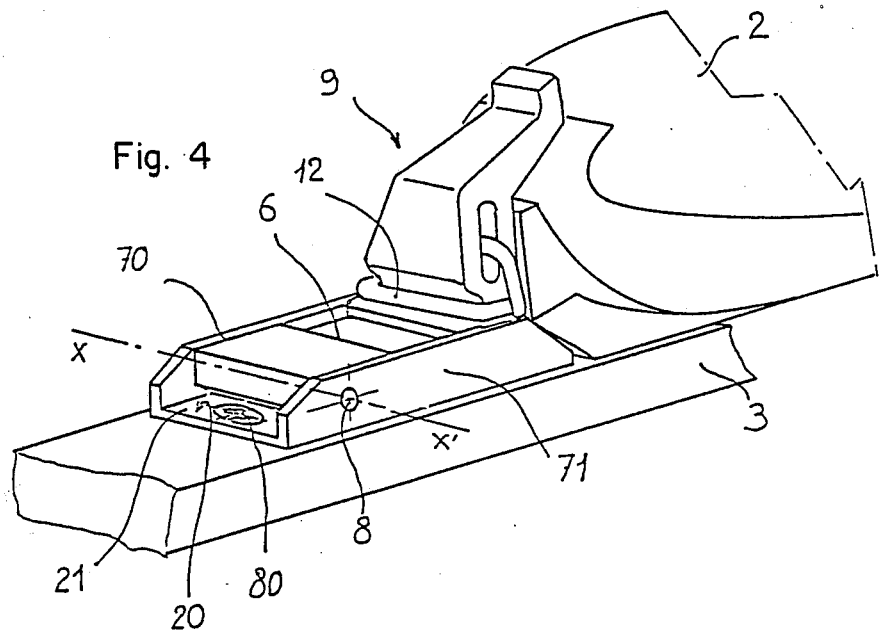

FIG. 1 illustrates the apparatus in the inactive position before insertion of the boot, and FIGS. 2–4 illustrate the apparatus in the active position with the boot inserted where the boot is to be retained.

Figure 5:
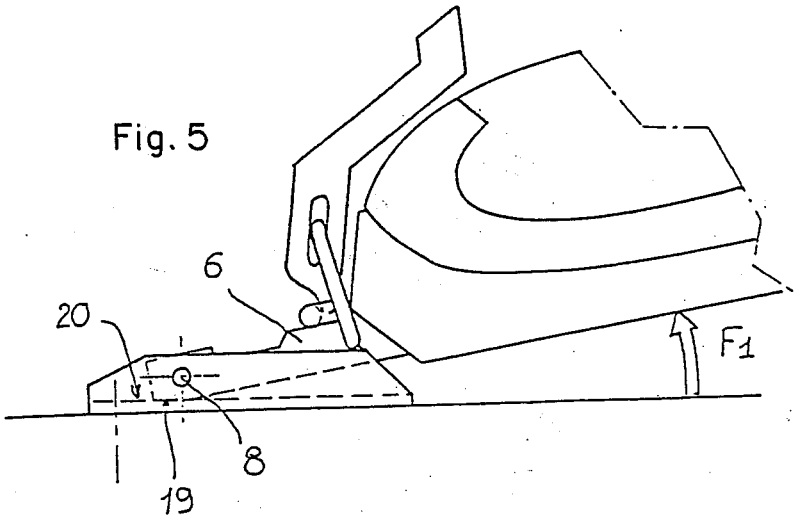
Figure 6:
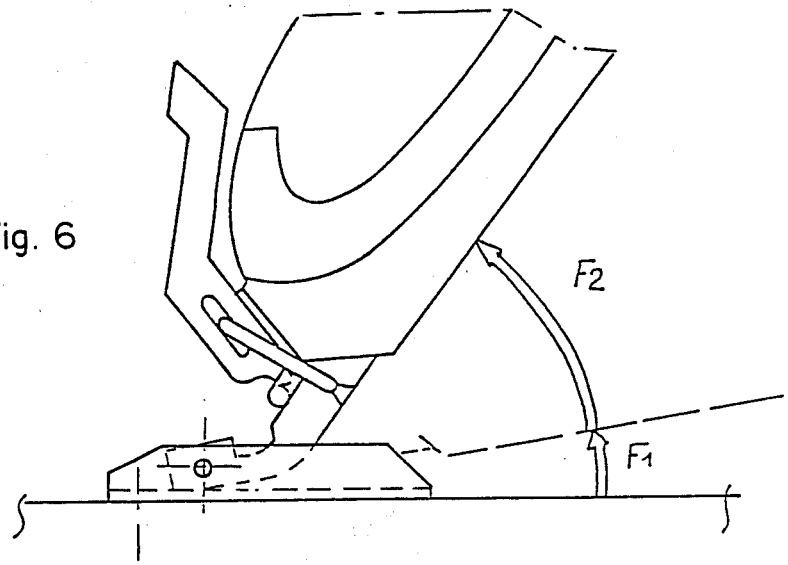
Figure 7:
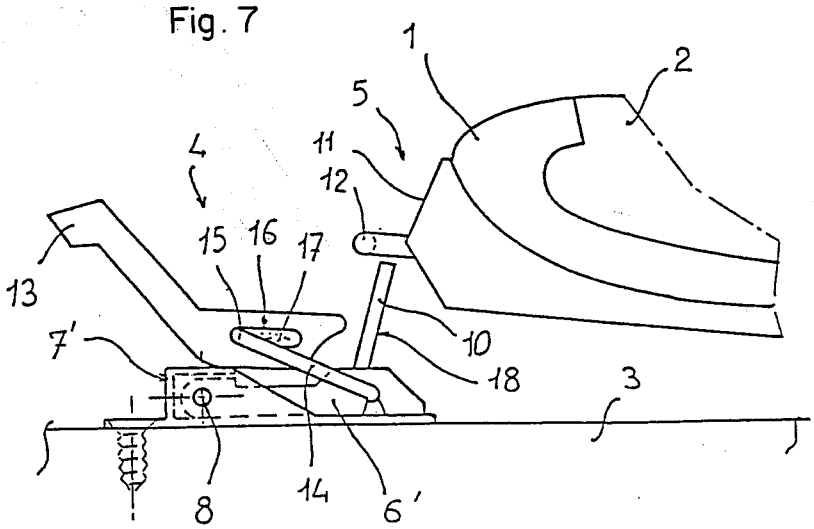
FIGS. 7–12 illustrate an alternative embodiment of the binding of the invention.
Figure 8:
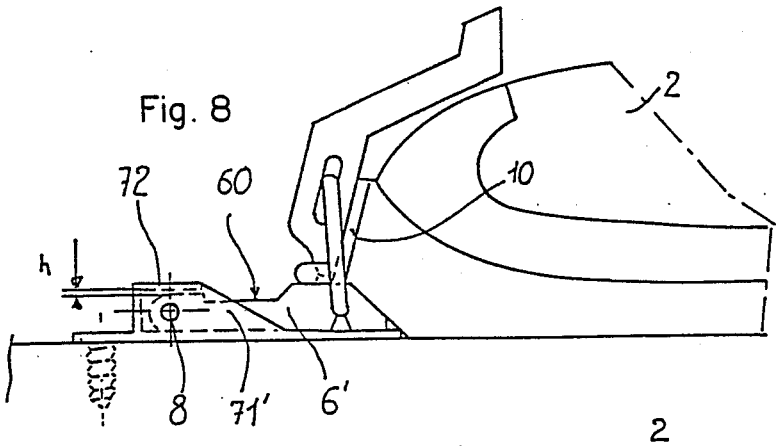
Figure 9:
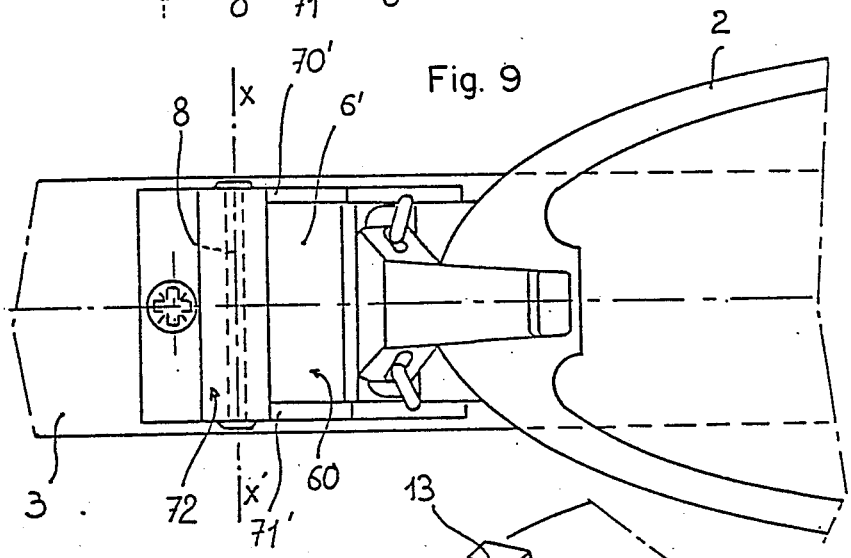
Figure 10:
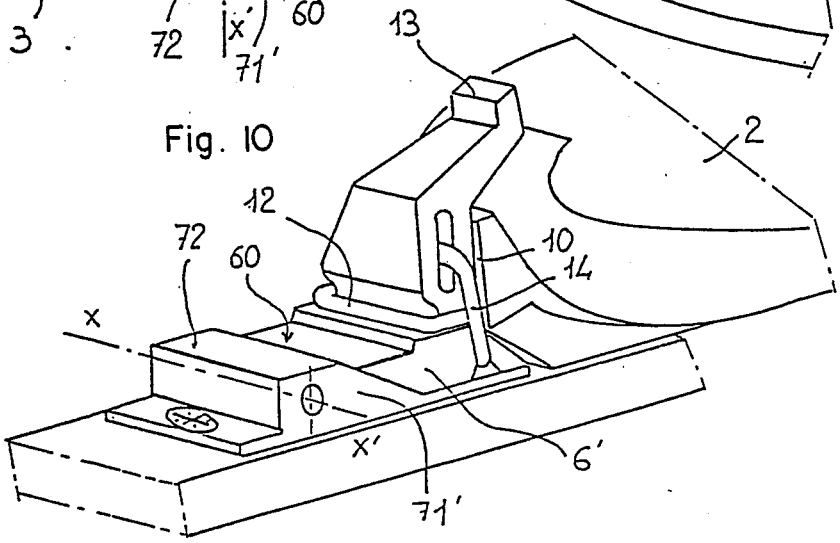
Figure 11:
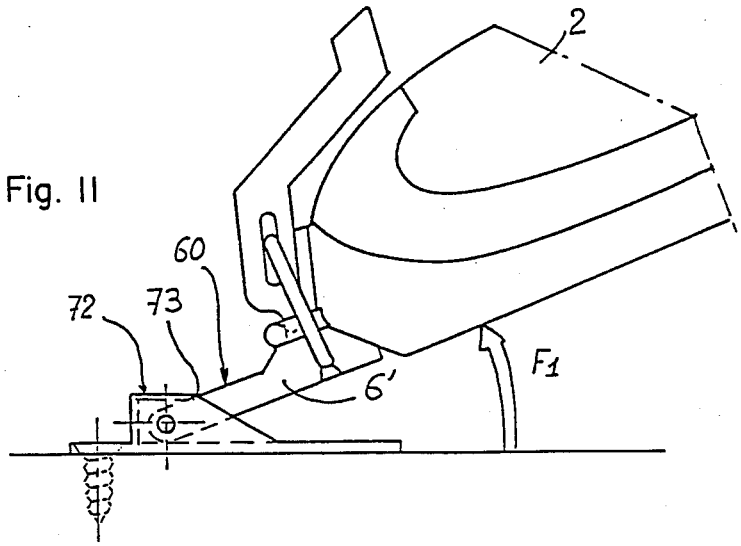
Figure 12:
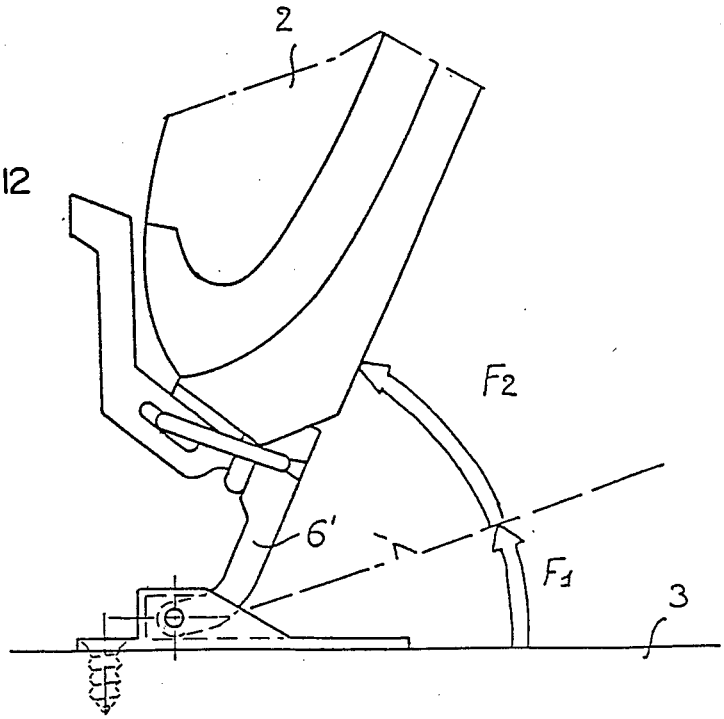

FIGS. 5 and 6 illustrate two phases of movement during lifting of the boot heel. The first phase involves a rotation around axis 8, which is followed by a second phase which is accompanied by flexion of the flexion element. To pass from the first phase to the second phase, an abutment system is provided which blocks rotation beyond a certain extent. To achieve this, the front end of the flexion element comprises an abutment surface 19 which is inclined upwardly (relative to the front of the binding). FIG. 5 illustrates the end of the first phase of movement during which the boot is lifted along direction $F_1$ by rotation around axis 8 until abutment surface 19 abuts against upper surface 20 of plate 21 of base plate body 7. Further pivoting of the flexion element is thus no longer possible, and any further lifting of the foot along direction $F_1$ results in flexion of the flexion element, as is shown in FIG. 6. Movement along the direction $F_1$ thus occurs by pivoting of the flexion element around axis 8, and subsequent movement along $F_2$ is accompanied by flexion of the flexion element.

FIGS. 6–12 illustrate an alternative abutment system. In this embodiment, the same elements are against present; namely, flexion element 6' on which the boot is attached by virtue of the same apparatus as was previously described. Flexion element 6' is pivotably journalled around transverse axis 8 of base plate body 7' which is attached to the ski. Body 7' comprises two lateral walls, 70' and 71', which support pivot axis 8 and are connected at their upper portions by a horizontal wall member 72. As may be seen from FIG. 8, horizontal upper wall member 72 is upwardly spaced by a distance h from upper surface 60 of flexible element 60'. This spacing allows for the free pivoting of element 6' around axis 8 until upper surface 60 abuts against portion 73 of wall 72 (see FIG. 11). Further pivoting is then blocked, and further movement of the boot occurs by flexion of flexion element 6'. Movement along $F_1$ thus occurs by pivoting of flexion element 6' around axis 8, and movement along direction $F_2$ occurs by flexion of flexion element 6'.

FIGS. 13–16 illustrate another embodiment in which it is not the flexion element which is journalled on the ski, but rather the end of the boot which pivots with respect to the flexion element. To achieve this, flexion element 6'' is attached to the ski at its front end by a body 7'' and a screw 8. At its rear end, flexion element 7'' comprises a shaped element having a rounded slide surface 60 which is transverse and in the shape of a semi-circle of radius "r". Movable latch 61 is journalled around a transverse axis 62. Latch 61 is in the form of a stirrup which is configured and made of steel spring wire having a circular cross-section whose free ends 63 and 64 act as a journal axis for the upper portion 65, which serves as a manipulation element. The free end of the boot comprises projection 30, whose lower portion comprises a shaped slide member which has an arcuate surface extending in the transverse direction 31, and has a shape which is complementary to the configuration of surface 60 and which cooperations therewith. The upper portion comprises a groove 32 which is adapted to receive horizontal arms 66 and 67 of latching element 61. The lower frontal portion comprises an abutment surface 33 constituted by a surface which is inclined upwardly and frontwardly.

Figure 13:
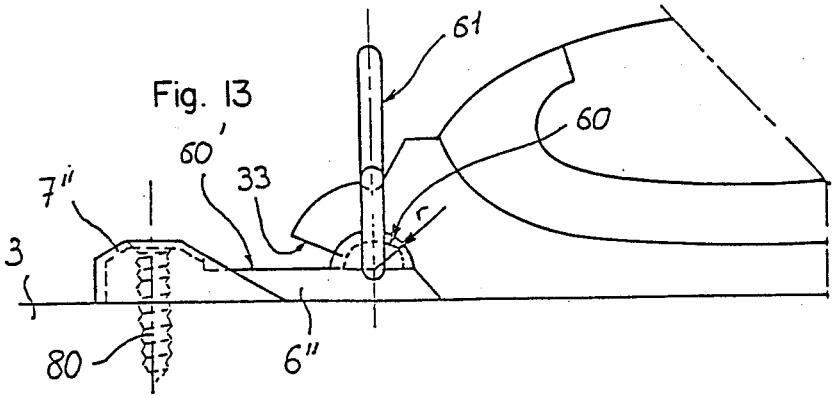
FIGS. 13–16 illustrate yet another embodiment of the invention.
Figure 14:
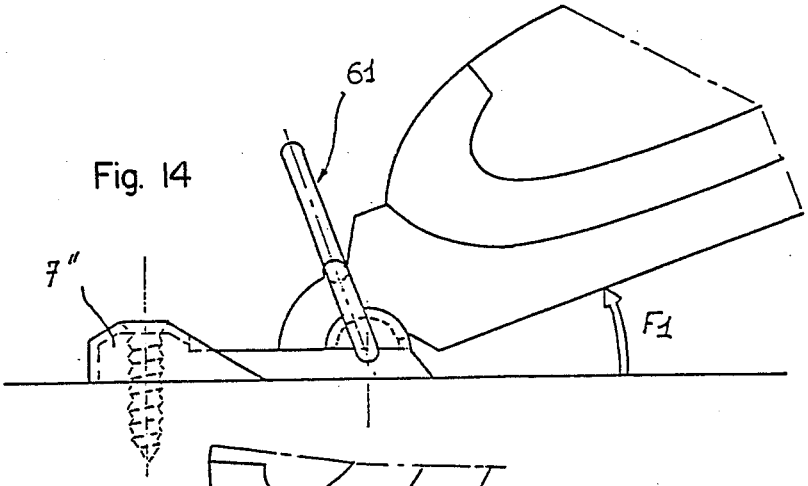
Figure 15:
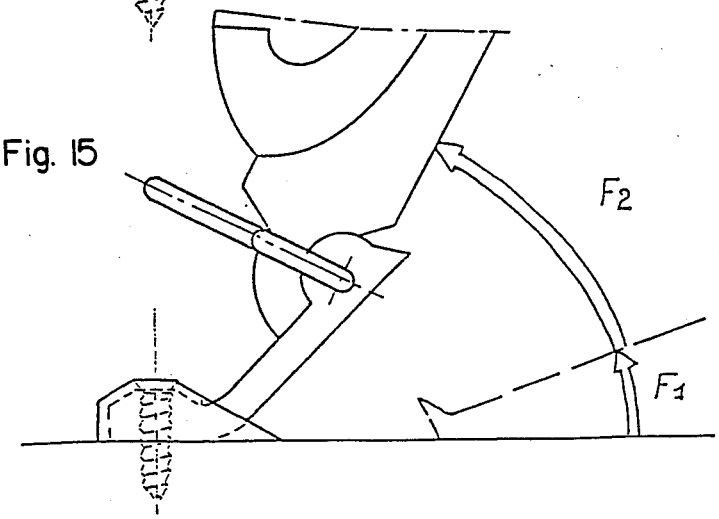
Figure 16:
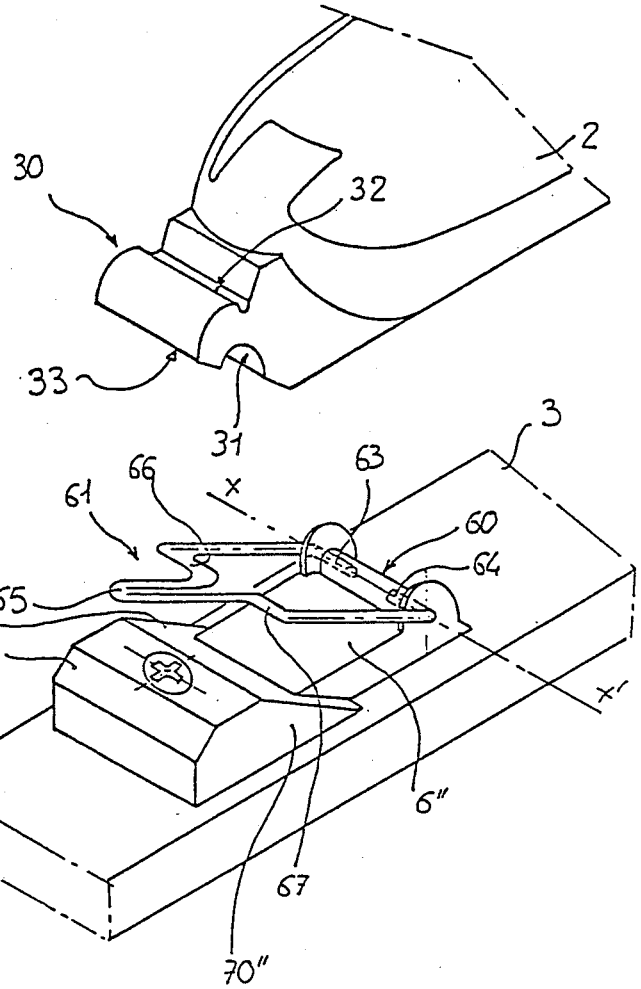

FIG. 13 illustrates the boot in the inserted position. Movement along direction $F_1$ occurs by rotation of the boot with respect to the flexion element around the fictional transverse axis XX', which passes through the center of the shaped projection having radius "r". When surface 33 abuts against upper element 60' of the flexible element, further rotation is no longer possible, and movement along direction $F_2$ occurs by flexion of the flexion element (see FIG. 15).

Figure 17:
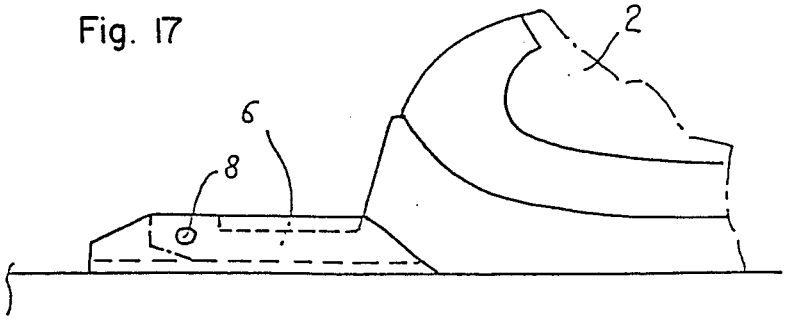
FIG. 17 illustrates yet another embodiment of the invention.

FIG. 17 illustrates an alternative embodiment in which flexion element 6 is definitively rendered integral with the boot, and remains permanently affixed thereto. It is thus possible, according to the invention, to provide for the flexion element to be either permanently or detachably secured to the boot with respect to each of the embodiments discussed above. The example set forth above illustates a number of ways of achieving such attachment although other techniques for accomplishing this aim are obviously possible.

In all of the embodiments shown above, the binding is mounted on a level surface of the ski. Also, the pivoting and flexional movements occur around real or virtual axes which are transverse and perpendicular to the longitudinal plane of symmetry. However, it is self-evident without going beyond the scope of the invention, that the journal axes. could also be skewed (non-transverse angle), as shown in French Patent Application No. 82,O7758, the disclosure of which is hereby incorporated by reference. Thus, the invention is not limited to the transverse pivot axes disclosed and may be used with bindings having pivot axes which are other than transverse to the general logitudinal orientation of the ski, boot, and binding.

It should also be noted that although an attempt has been made to include reference to all shoes and boots used in the manner of the invention, it is to be understood that the invention is not limited to any one particular shoe structure and extends to all equivalents within the scope of the claims. Likewise, the application refers to "pivoting" and "flexion" as representing two different types of motion. It is to be understood, however, that what these terms intend to imply is that during "pivoting" there is a relatively free lifting of the heel, while during "flexion" the flexion element presents a resistance to further lifting which results in a moment forcing the front tips of the skis downwardly.

Finally, although the invention has been disclosed and described with reference to particular means, embodiments, and materials, it is to be understood that the invention is not limited to the particulars disclosed but extends to all equivalents within the scope of the claims.

What is claimed is:

1. A ski binding comprising:

means for securing a ski shoe or boot to a ski in a manner which permits the heel of the shoe or boot to be lifted away from the ski;

a flexion element connected to said boot and said ski, wherein said flexion element extending forwardly of the toe of the boot comprises means for flexing in a response to lifting of the heel of said boot beyond a predetermined extent; and means for preventing non-flexional displacement of said flexion element when said boot is lifted beyond said predetermined extent.

2. The ski binding as defined by claim 1 wherein said flexion element is adapted to be secured at one end thereof to said shoe or boot and at the other end thereof to said ski.

3. The ski binding as defined by claim 2 wherein said flexion element is secured at one end thereof to said shoe or boot by said pivot means which allows said shoe or boot to pivot relative to said flexion element as the heel of said shoe or boot is lifted off of said ski.

4. The ski binding as defined by claim 3 wherein the end of said flexible element secured to said ski is fixedly secured thereto in a manner which prevents pivotable movement of said flexion element off of said ski.

5. The ski binding as defined by claim 4 wherein said pivot means comprises a rounded surface at the end of said flexion element; and a cooperating slide element associated with said boot; and wherein said pivot means comprises a movable latch for pivotably securing said boot to said flexion element, whereby said slide element overlays said rounded surface and slides thereover as the heel of said shoe or boot is lifted and said shoe or boot pivots. —

6. The ski binding as defined by claim 5 wherein said movable latch is pivotably secured to said one end of said flexion element.

7. The ski binding as defined by claim 6 wherein said flexion element is fixedly secured to said ski by an arch plate adapted to be secured to said ski, said arch plate having lateral upright walls adapted to prevent substantial rotation of said binding around an axis transverse to the flat surface of the ski.

8. The ski binding as defined by claim 3 wherein said flexion element is pivotably secured to said ski at one end thereof.

9. The ski binding as defined by claim 8 wherein said flexion element is secured to said boot at another end thereof in a manner which allows for substantially no relative pivotable movement between said end secured to said boot and said boot.

10. The ski binding as defined by claim 9 wherein said boot is detachably secured to said flexion element.

11. The ski binding as defined by claim 10 wherein said flexion element comprises an upstanding support element having an opening therein adapted to receive a forwardly extending latching element of said boot therein; and a movable latch adapted to secured said boot to said flexion element by locking said forwardly extending latching element in position relative to said upstanding support element.

12. The ski binding as defined by claim 9 wherein said boot is integral with said flexion element.

13. The ski binding as defined by claim 9 wherein the end of said flexion element which is is adapted to be pivotably secured to said ski is pivotably secured to a base plate adapted to be secured to said ski.

14. The ski binding as defined by claim 13 wherein said base plate comprises two uprights, with said end of said flexion element being pivotably secured between said uprights.

15. The ski binding as defined by claim 14 wherein said end secured to said base plate has a partially inclined abutment surface which permits said flexion element to pivot upwardly as said heel is raised, and wherein said flexion element is secured relative to said base plate such that when said heel has been raised by a predetermined extent said abutment surface presses against said base plate to prevent further pivoting thereof, after which further lifting of said heel results in said flexion element being flexed.

16. The ski binding as defined by claim 14 wherein said base plate further comprises a horizontal member extending between said uprights, and wherein said flexion element has a rounded end pivotably secured to said base plate, and whereby said horizontal member is positioned to prevent pivoting of said flexion element relative to said base plate after said heel has been raised by said predetermined extent.

17. A ski binding comprising:

means for securing a ski shoe or boot to a ski in a manner which permits the rear of the shoe or boot to be lifted away from the ski without flexing of the top portion of the boot;

a flexion element extending forwardly of the toe portion of said boot and connected to said boot and said ski and comprising means for flexing in response to lifting of the rear of the shoe or boot away from said ski beyond a predetermined extent; and means for preventing non-flexional displacement of said flexion element when said boot is lifted beyond said pre-determined extent.

18. A ski binding comprising:

pivot means positioned forwardly of a toe portion of a ski shoe or boot to be secured to said ski for pivotally securing said ski shoe or boot to a ski in a manner which permits the rear of the shoe or boot to be lifted away from the ski to a predetermined extent;

a flexion element connected to said shoe and said ski and adapted to be displaced by flexing with respect to said ski, wherein said flexion element flexes after said heel has been lifted beyond said predetermined extent; and means for preventing pivoting of said flexion element relative to said binding beyond said predetermined extent.

19. The ski binding as defined by claim 18 wherein said boot is adapted for use in cross-country or mountaineer skiing.

20. The ski binding as defined by claim 18 wherein said flexion element is journalled to the ski around a transverse axis.

21. The ski binding as defined by claim 20 wherein said flexion element is adapted- to be journalled to the ski, around a journal axis, by its front end, relative to the orientation of the boot, and wherein the rear end thereof, relative to the orientation of the boot, is secured to the front end of said boot.

22. The ski binding as defined by claim 21 wherein said journal axis is positioned between two uprights of a base plate adapted to be secured to the ski by screws, the lower portion of said base plate comprising a flat horizontal plate connecting said two uprights.

23. The ski binding as defined by claim 22 wherein said flexion element comprises an abutment surface at the end of said flexion element adjacent to said journal axis, said abutment surface being positioned to contact the upper surface of said horizontal plate so as to prevent further pivoting of said flexion element after said heel has been raised by a predetermined extent.

24. The ski binding as defined by claim 22 wherein said vertical walls are connected above said journal axis by a horizontal member to define a space having a height greater than the thickness of said flexion element, said horizontal member serving as an abutment to block rotation of said flexion element, after said heel has been lifted to said predetermined extent.

25. The ski binding as defined by claim 18 wherein said flexion element is attached to the ski by its front end, relative to the eventual orientation of the boot, and the rear end of the flexion element, relative to the eventual orientation of the boot, comprises said pivot means.

26. The ski binding as defined by claim 25 wherein said pivot means comprises a transverse element having a semi-circular rounded surface, with a longitudinal central transverse journal axis; and wherein said pivot means further comprises a slide element complementary in profile to said rounded surface so as to slidably mate therewith; said rounded surface ending in an abutment surface positioned to cooperate with the upper surface of said flexion element to prevent further pivoting of said boot once said heel has been lifted by a predetermined extent.

27. The ski binding as defined by claim 26 wherein said slide element is permanently affixed to the front end of said shoe or boot.

28. The ski binding as defined by claim 26 further comprising a movable latch for pivotably latching said shoe or boot to said flexion element, said movable latch comprising a clamp pivotably mounted around said longitudinal central transverse journal axis.

29. The binding as defined by claim 1 in combination with said shoe or boot, wherein said binding further comprises a slide surface corresponding to a rounded surface on said boot or shoe, wherein said shoe or boot is adapted for use in cross-country or mountaineering skiing, said forwardly extending latching element having a rounded surface thereon, said latching element being configured for attachment to said ski by means of said ski binding, and wherein said rounded surface is positioned and configured to cooperate with said corresponding slide surface on said binding as the heel of said shoe or boot is lifted which results in the pivoting of said shoe or boot.

30. The shoe or boot as defined by claim 29 further comprising a groove extending transverse to the general orientation of said shoe or boot, said groove being configured to seat a movable latch therein.

31. The shoe or boot as defined by claim 30 wherein said rounded surface is located on the underside of said projection.

32. A binding sub-assembly for use in a ski binding, said binding sub-assembly comprising:

(a) a flexible flexion element adapted to be secured to extend forwardly of the toe portion of a ski shoe or boot for securing said shoe or boot to a ski; and (b) pivot means for pivotally attaching said flexion element to said ski in a manner which allows for pivoting of said boot relative to said ski as the heel of said shoe or boot is raised, said pivot means comprising abutment means for limiting the pivoting extent of said flexion element to a predetermined extent, whereafter further lifting of the heel results in flexion of said flexion element.

33. The binding defined by claim 1 wherein said means for preventing non-flexional displacement of said flexion element prevents pivotal displacement of said flexion element when said boot is lifted beyond said predetermined extent.

34. The binding defined by claim 17 wherein said means for preventing non-flexional displacement of said flexion element prevents pivotal displacement of said flexion element when said boot is lifted beyond said predetermined extent.

35. The binding defined by claim 1 wherein said flexion element further comprises means for pivoting and flexing sequentially.

36. The binding defined by claim 35 wherein said flexion element comprises means for pivoting and flexing sequentially so that said flexion element only pivots before the heel of said boot has been lifted beyond said predetermined extent and said flexion element only flexes after said heel has been lifted to beyond said predetermined extent.

37. The binding defined by claim 17 wherein said flexion element further comprises means for pivoting and flexing sequentially.

38. The binding defined by claim 35 wherein said flexion element comprises means for pivoting and flexing sequentially so that said flexion element only pivots before the rear of said boot has been lifted beyond said predetermined extent and said flexion element only flexes after said rear of said boot has been lifted to beyond said predetermined extent.

39. The binding defined by claim 18 wherein said flexion element further comprises means for pivoting and flexing sequentially.

40. A ski binding comprising:

a flexion element adapted to extend forwardly of a shoe or boot and to be connected to a shoe or boot and said ski, wherein said flexion element comprises:

means for permitting the heel of said shoe or boot to be lifted away from said ski; and means for sequentially pivoting said then only flexing said flexion element after a predetermined extent of pivoting in response to lifting of said heel of said shoe or boot away from said ski.

* * * * *